US008739925B1

(12) United States Patent
Perdue

(10) Patent No.: US 8,739,925 B1
(45) Date of Patent: Jun. 3, 2014

(54) PORTABLE AND STORABLE DEVICE FOR ACOUSTIC MODIFICATION

(71) Applicant: Joab Jay Perdue, Erin, TN (US)

(72) Inventor: Joab Jay Perdue, Erin, TN (US)

( * ) Notice: Subject to any disclaimer, the term of this patent is extended or adjusted under 35 U.S.C. 154(b) by 0 days.

(21) Appl. No.: 13/788,245

(22) Filed: Mar. 7, 2013

(51) Int. Cl.

| | |
|---|---|
| ***E04B 1/84*** | (2006.01) |
| ***E04B 1/344*** | (2006.01) |
| ***G10K 11/168*** | (2006.01) |
| *E04B 1/82* | (2006.01) |
| *E04B 1/343* | (2006.01) |
| *G10K 11/16* | (2006.01) |

(52) U.S. Cl.
USPC ..... 181/290; 181/287; 181/205; 52/145; 52/71

(58) Field of Classification Search
USPC ..... 181/290, 293, 287, 284, 205, 198; 52/144, 145, 71
See application file for complete search history.

(56) References Cited

U.S. PATENT DOCUMENTS

| | | | | | |
|---|---|---|---|---|---|
| 3,687,170 | A * | 8/1972 | Malone et al. | 138/143 |
| 3,890,108 | A * | 6/1975 | Welsh | 428/593 |
| 4,193,474 | A * | 3/1980 | Okubo et al. | 181/287 |
| 4,214,646 | A * | 7/1980 | Planes et al. | 181/287 |
| 4,480,715 | A * | 11/1984 | Brooks | 181/287 |
| 4,722,760 | A * | 2/1988 | Shimada | 156/214 |
| 4,821,787 | A * | 4/1989 | Swanson | 160/135 |
| 5,115,855 | A * | 5/1992 | Lindblom et al. | 160/135 |
| 5,411,623 | A * | 5/1995 | Shutt | 156/290 |
| 5,783,268 | A * | 7/1998 | Noonan et al. | 428/34.5 |
| 6,446,751 | B1 * | 9/2002 | Ahuja et al. | 181/295 |
| 7,076,922 | B1 * | 7/2006 | Parres | 52/79.5 |
| 7,329,456 | B2 * | 2/2008 | Tilton et al. | 428/212 |
| 7,690,158 | B2 * | 4/2010 | Kelly | 52/145 |
| 7,874,400 | B2 * | 1/2011 | Teisseyre | 181/200 |
| 2001/0031336 | A1 * | 10/2001 | Born | 428/167 |
| 2002/0025404 | A1 * | 2/2002 | Taber et al. | 428/118 |

* cited by examiner

*Primary Examiner* — Edgardo San Martin
(74) *Attorney, Agent, or Firm* — David Douglas Winters

(57) ABSTRACT

A portable and storable device for acoustic modification with segments foldable back upon each other.

11 Claims, 12 Drawing Sheets

PORTABLE AND STORABLE DEVICE FOR ACOUSTIC MODIFICATION

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

When audio, in example music or speech, is generated for listeners or for recording, it is most desirable that the audio quality be uniform and as true to the original as possible within a reasonable range of distances and angles. However, sounds produced in closed spaces may not be of uniform volume, color, or clarity throughout such spaces due to distortions caused by interference, by reflections off interior surfaces resulting from dimensions and configurations of the closed spaces relative to frequencies of sounds produced therein.

Therefore sounds heard or recorded in one part of a room might not be the same as sounds heard or recorded in another part of the same room. However, it is well known that venues wherein sounds are produced for hearing by many people or for recording, in examples auditoria, concert halls, playhouses, movie theaters, recording studios and the like, may be modified to minimize such distortions by the strategic placement of acoustic panels which absorb and/or reflect chosen sound frequencies. The necessary physical modifications for such venues are generally expensive and permanent.

However, occasion often arises for audio production or reproduction in spaces not ideally constructed for audio performances, such as gymnasia, garages, basements, fellowship halls, etc. But, permanent modification of said areas is usually not cost effective and often would interfere with said primary uses.

Thus arises a need for inexpensive acoustic panels which can be quickly and easily transported and deployed to temporarily modify the acoustic characteristics of such spaces, and which can be easily dismantled and stored in a minimum of space.

BRIEF SUMMARY OF THE INVENTION

It is an object of the present invention to provide an acoustic panel that may be temporarily deployed.

It is an object of the present invention to provide an acoustic panel that may be easily set up and taken down.

It is an object of the present invention to provide an acoustic panel that may easily be broken down or folded up into a minimum volume.

It is an object of the present invention to provide an acoustic panel that in its broken down or folded up state may be easily transported and/or stored.

It is an object of the present invention to provide an acoustic panel that may be utilized to alter the acoustic properties of a room or other space.

It is an object of the present invention to provide an acoustic panel that may be used to set up a sound isolation chamber.

It is an object of the present invention to provide an acoustic panel that may be easily and inexpensively fabricated.

It is an object of the present invention to provide an acoustic panel that may be manufactured to have various acoustic properties by varying, adding, or eliminating inexpensive elements.

It is an object of the present invention to provide components which may function separately or which may communicate to form a device to alter the acoustic properties of a space by absorbing or blocking sound.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF NUMBERED COMPONENTS

Figure 1:
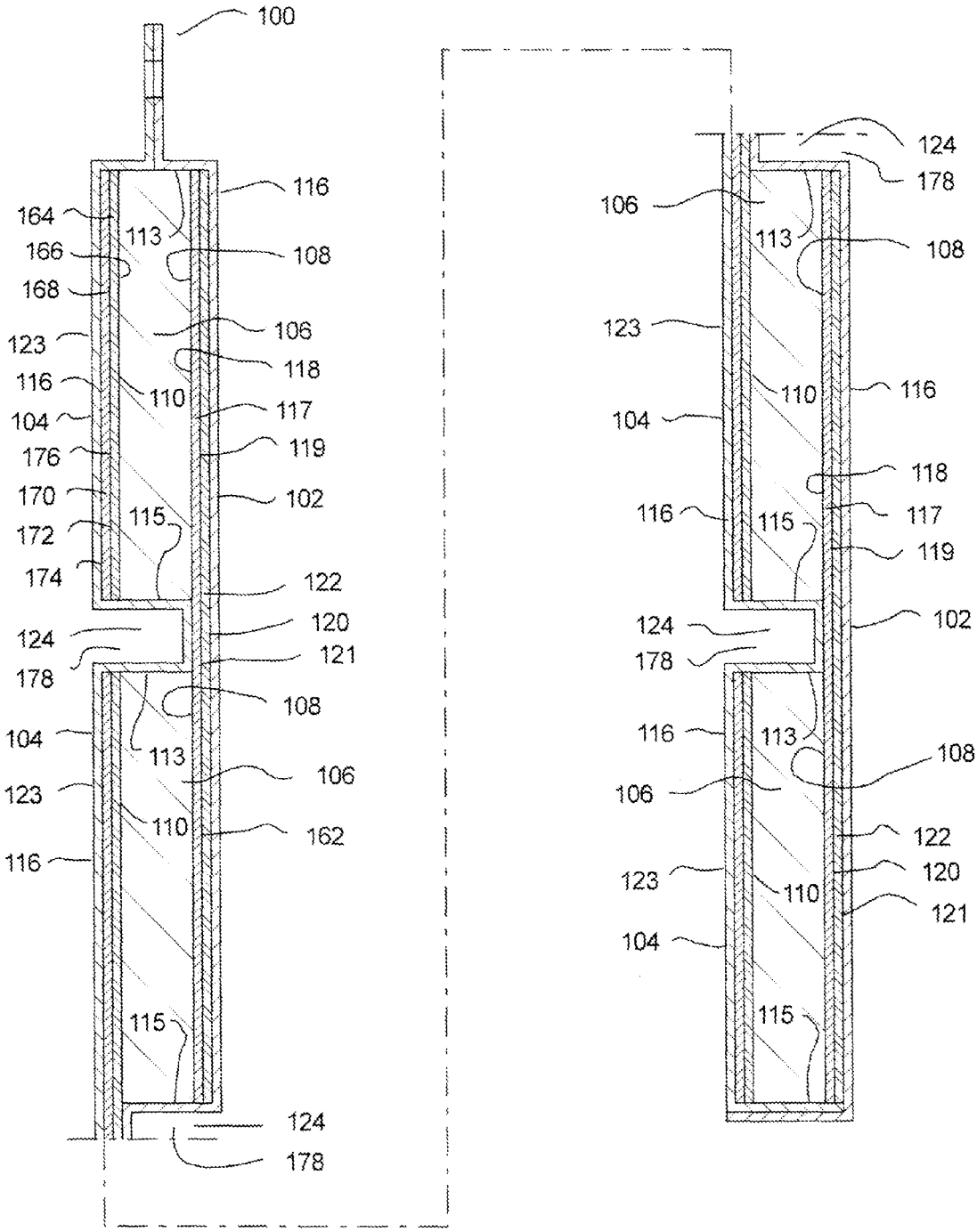
FIG. 1 is a cross sectional side view of an embodiment of the invention.

100 Segmented acoustic panel
102 Segmented acoustic panel first face

104 Segmented acoustic panel second face
106 Segment core
108 Segment core first side
110 Segment core second side
112 Segment core first end
113 Segment core top side
114 Segment core second end
115 Segment core bottom side
116 Outer covering
117 Inner acoustic sheet
118 Inner acoustic sheet first side
119 Inner acoustic sheet second side
120 Outer acoustic sheet first side
121 Outer acoustic sheet second side
122 Outer acoustic sheet
123 Panel segment
124 Panel gap
125 Second panel segment
126 Flange
128 Mounting hole
130 Collapsible stand
132 Collapsible stand cross member
136 Segmented acoustic panel case
137 Segmented panel compartment
138 Collapsible stand pocket
140 Cross member hook
142 Cross member bolt
144 Segmented panel end
146 Segmented panel pad
148 Segmented panel groove
149 Segmented panel groove seat
150 Acoustic shield
152 Acoustic shield section
153 Acoustic shield section bottom end
154 Acoustic isolation chamber
156 Acoustic isolation chamber top
158 Shield section linear clamp
160 Shield section corner clamp
162 Acoustic belt
164 Short inner acoustic sheet
166 Short inner acoustic sheet first side
168 Short inner acoustic sheet second side
170 Short outer acoustic sheet
172 Short outer acoustic sheet first side
174 Short outer acoustic sheet second side
176 Short acoustic belt
178 Gap open space
180 Hinge
182 Segmented panel top side
184 Acoustic box
188 Surface
192 Key
194 Screw
196 Connective device
198 Hook
200 Plate
202 Recess
204 Handle

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 2:
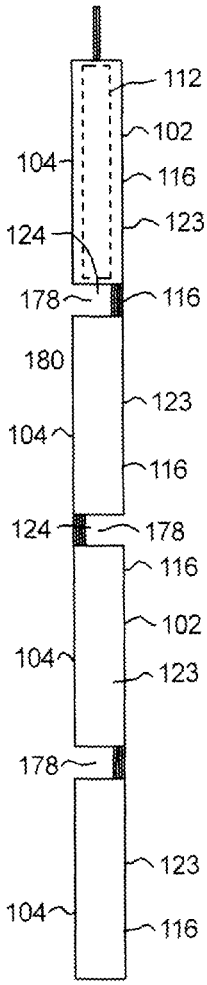
FIG. 2 is a left side view of an embodiment of the invention.
Figure 3:
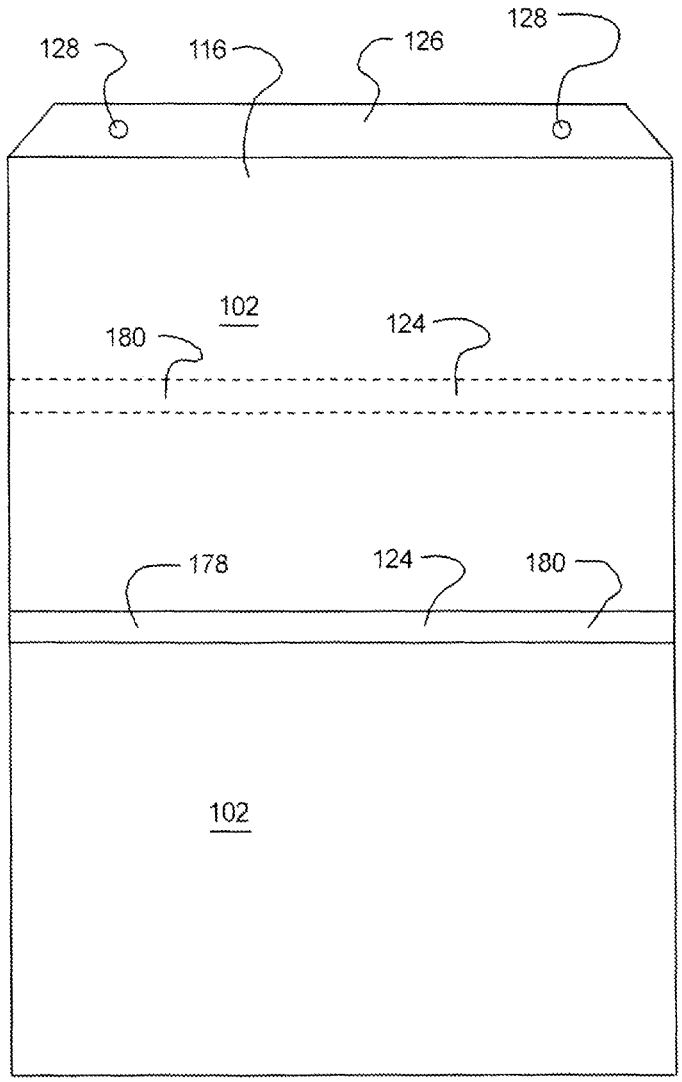
FIG. 3 is a front view of an embodiment of the invention.

FIGS. 1, 2, and 3 show an acoustical panel (100) having segments (123) and having a first face (102) and a second face (104) essentially parallel to the first face (102) with a plurality of substantially adjacent segment cores (106) with a gap (124) between each segment core (106). The panel segment cores (106) have a first side (108), second side (110) opposite the first side (108), a top side (113) and a bottom side (115) opposite the top side (113), a first end (112), and a second end (114) opposite the first end (112). The first end (112) and the second end (114) are each contiguous with the panel segment core first side (108) second side (110), top side (113), and bottom side (115).

Also shown are at least one inner acoustic sheet (117) having a first side (118) and a second side (119) and at least one outer acoustic sheet (122) having a first side (120) and a second side (121). Additionally, as seen in FIG. 1, the acoustic sheet first side (118) is disposed essentially contiguous one segment core first side (108) and the adjacent segment core first side (108). Also, at least one outer acoustic sheet (122) having a first side (120) and a second side (121) is disposed so that the outer acoustic sheet first side (120) is essentially contiguous to the inner acoustic sheet second side (119). The inner acoustic sheet (117) and outer acoustic sheet (122) thusly comprise an acoustic belt (162). Additionally understood is that the surface area of the acoustic belt (162) is sufficient to cover the first sides (108) of two adjacent segment cores (106) and to span the gap between the essentially adjacent segment cores (106) as shown in FIG. 1A.

Figure 1A:
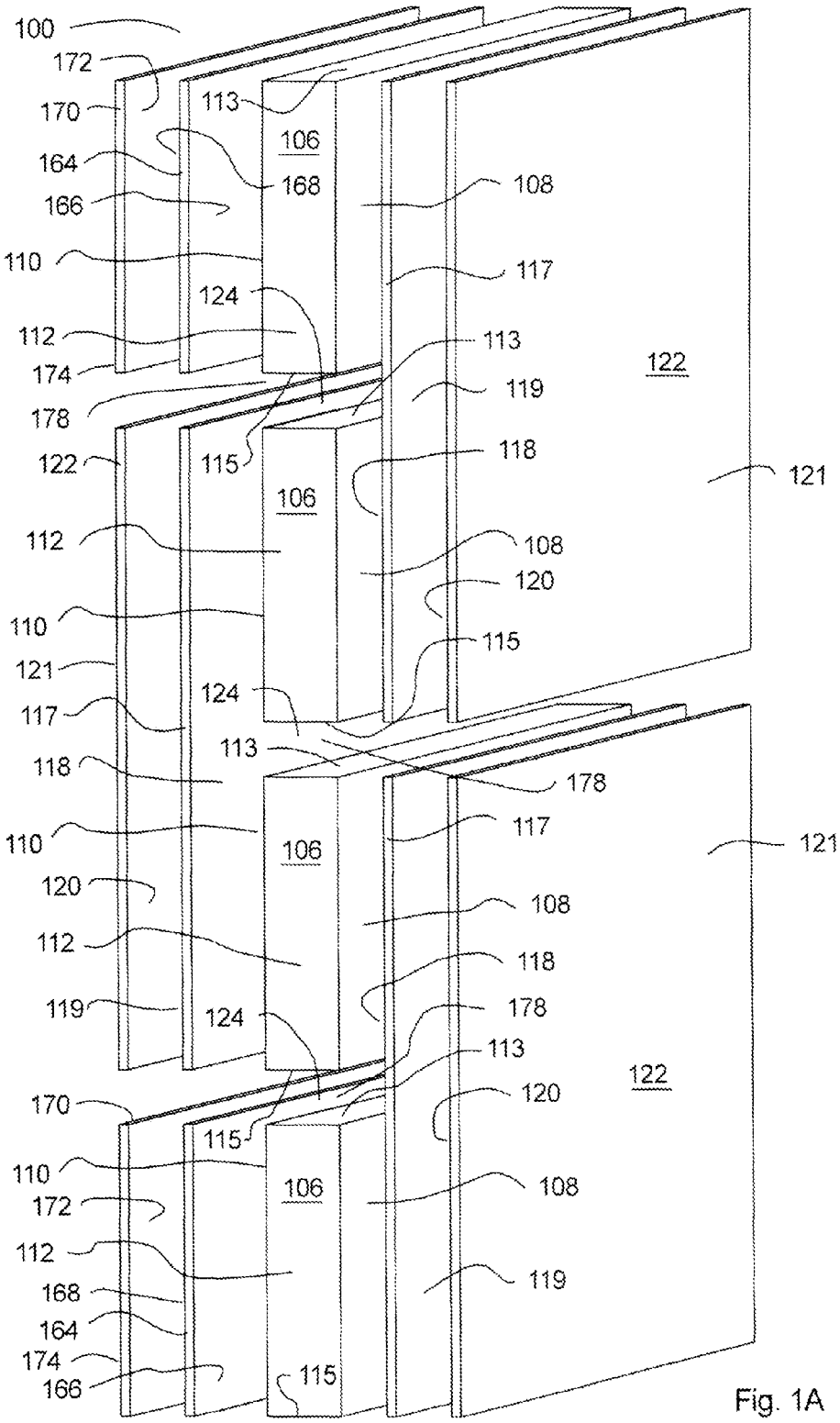
FIG. 1A is an exploded view of elements of an embodiment of the invention.

FIGS. 1 and 1A show at least one short inner acoustic sheet (164) having a first side (166) and a second side (168) and at least one short outer acoustic sheet (170) having a first side (172) and a second side (174). The short inner acoustic sheet first side (166) is oriented essentially contiguous one segment core second side (110) and the short outer acoustic sheet first side (172) is positioned essentially contiguous the short inner acoustic sheet second side (168). Thus, the short inner acoustic sheet (164) and the short outer acoustic sheet (170) comprise a short acoustic belt (176).

The short acoustic belt (176) has an area essentially equal to the area of the segment core second side (110) and the short acoustic belt (176) does not span the gap (124) between adjacent segment cores (106) as is seen in FIGS. 1 and 1A.

Figure 1B:
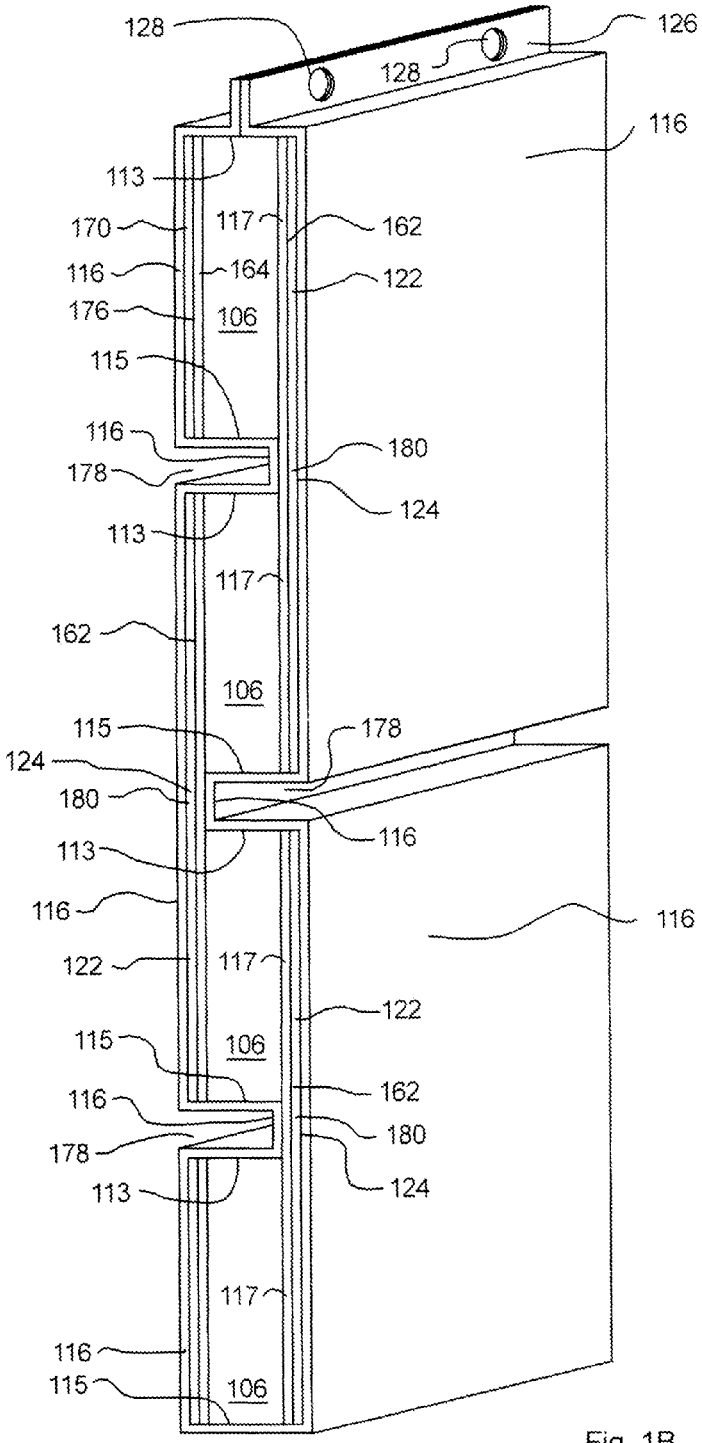
FIG. 1B is an elevational view of elements of an embodiment of the invention.
Figure 2A:
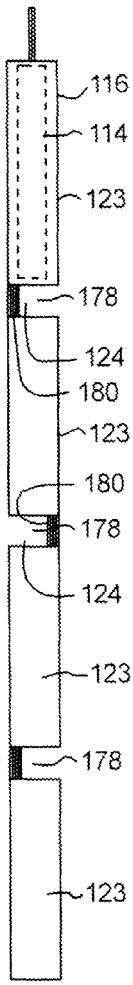
FIG. 2A is a right side view of an embodiment of the invention

Shown in FIGS. 1 and 1B is an outer covering (116) which encloses the segment cores (106), the acoustic belt, or belts, (162), and the short acoustic belt, or belts (176). The outer covering may (116) comprise sufficient surface area to also cover every segment core top side (113), and bottom side (115), and the portion of the acoustic belt, or belts, (162) which spans the gap, or gaps, (124). Additionally, FIGS. 2 and 2A show that the outer covering (116) may also be of sufficient area to cover each segment core first end (112) and each segment core second end (114).

It will be readily appreciated that the outer covering (116) dimensions and/or configurations may be easily contrived by one skilled in the art to conform to whatever surfaces of the elements comprising the segmented acoustic panel (100) surface deemed necessary by one skilled in the art to provide required segmented acoustic panel (100) properties.

It will also be understood that the acoustic belts (162) and/or the short acoustic belts (170) may communicate with the appropriate, as previously described, segment core surfaces such that operative disposition of the elements may be maintained. In example, the surfaces of the acoustic belts (162), and/or components thereof, short acoustic belts (170), and/or components thereof, and the segment core (106) surfaces in contact with one another may comprise adhesive. Alternatively, the operative communication may be accomplished by friction, or compression, fit between the outer covering (116) and the elements.

It will be readily appreciated that if the operative communication is maintained by adhesive, the outer covering (116) may be eliminated, as shown in FIG. 1A, if the desired acoustic properties can be accomplished by the acoustic belts (162) and or short acoustic belts (170) alone and/or the acoustic belts (162) and or short acoustic belts (170) comprise material that may not be covered as required by law or practicality.

It will be readily appreciated that the outer covering (116), the segment cores (106), the inner acoustic sheets (118), outer acoustic sheets (120), short inner acoustic sheets (164), short outer acoustic sheets (170) comprise acoustic properties, in example sound absorption or reflection capabilities, which may vary from element to element but when comprising combinations, may render to a segmented acoustic panel (100) as previously described, ability to modify the acoustic properties of a space so that essentially uniform sound throughout the space may be produced from a source or sources within the space.

It will also be understood that varying the acoustic properties of the aforementioned elements, or the elimination or addition of additional the elements, will vary the acoustic properties of the segmented panel (100) they comprise. Thus, the panels may be customized to accomplish modification of spaces having differing configurations and/or compositions. And since the segment cores (106) are the most expensive components of the segmented acoustic panels (100) while the additional recited elements are cheap in comparison, and the acoustic properties of the panels (100) may be altered by modification of the relatively cheap additional elements without modification of the segment cores (106), segmented acoustic panels (100) of varying properties may be fabricated from uniform segment cores (106) thusly decreasing the cost of fabricating segmented acoustic panels (100) of varied characteristics.

FIGS. 1 and 1A show an acoustic belt (162) as previously described extending from the segment core second side (110) of the segment core (106) adjacent to the segment core (106) having its second side (110) essentially contiguous with the short acoustic belt (176). The acoustic belt (162) thus extends from the segment core top side (113) to another adjacent segment core bottom side (115) and spans the gap (124) between the segment cores (106).

It will be additionally noted that each gap (124) will have one end spanned by the acoustic belt (162) and the outer covering (116) while the other end is not so spanned thusly comprising gap open spaces (178) between the adjacent segment cores (106). It will also be readily appreciated that due to the disposition of the short acoustic belt (176) essentially contiguous with the segment core second side (110) as shown in FIG. 1, the gap open spaces (178) are comprised alternately by the segmented panel second face (104) and the segmented panel second face (102).

Figure 7:
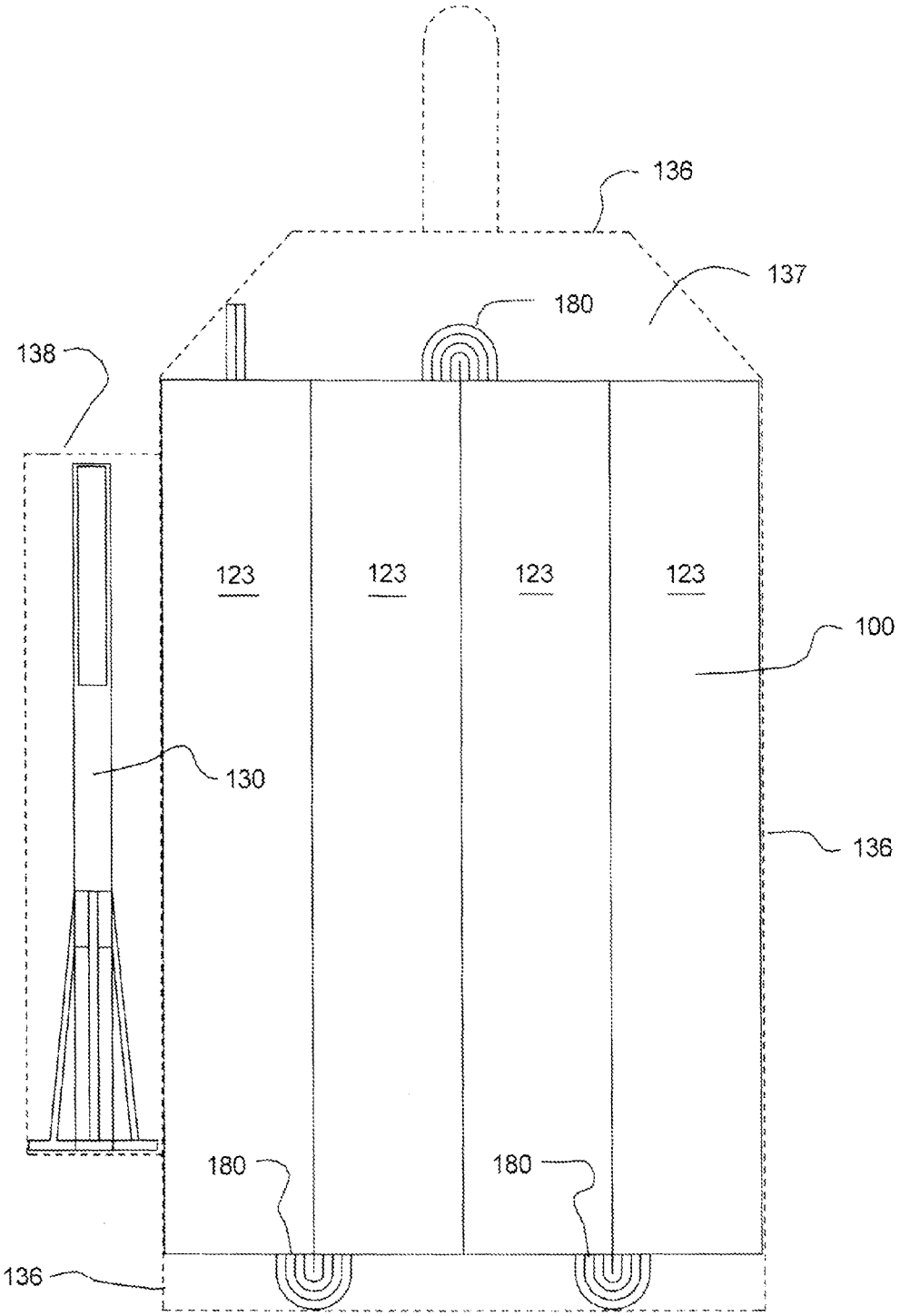
FIG. 7 is a side view of an embodiment of the invention with an associated component shown in broken lines.

It will be understood that the portions of the acoustic belt (162) and the portions of the outer covering (116) which span the gaps (164) between adjacent segment cores (106) are sufficiently flexible and/or of sufficient strength and/or durability that the portions of the acoustic belt and the outer covering (116) may comprise a hinge (180). Thus, the panel segments (123) may be folded back upon themselves, as seen in FIG. 7.

FIGS. 1, 1A, 2, 3, 4, 5, and 6 show that the outer covering may comprise a flange (126) extending from the segmented acoustic panel (100), the flange (126) comprising means, in example a mounting hole (178) or a plurality thereof, to communicate with a variety of connective devices, whereby the segmented acoustic panel (100) may be suspended.

Figure 4:
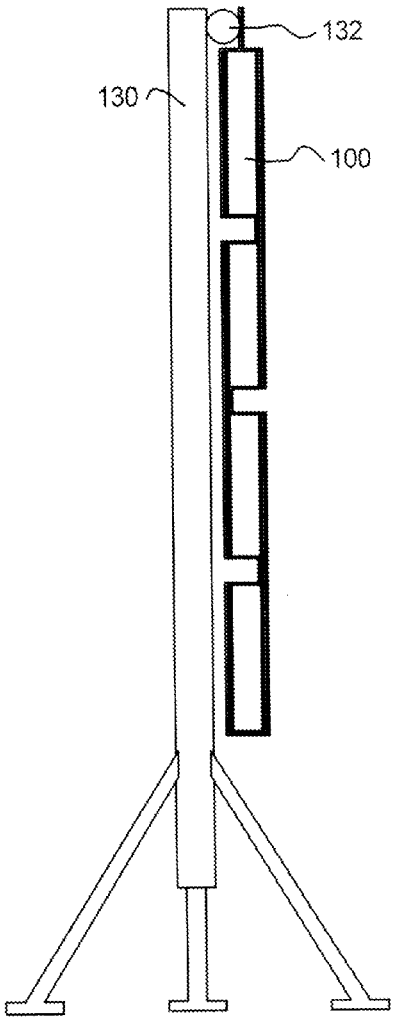
FIG. 4 is a left side view of an embodiment of the invention.
Figure 5:
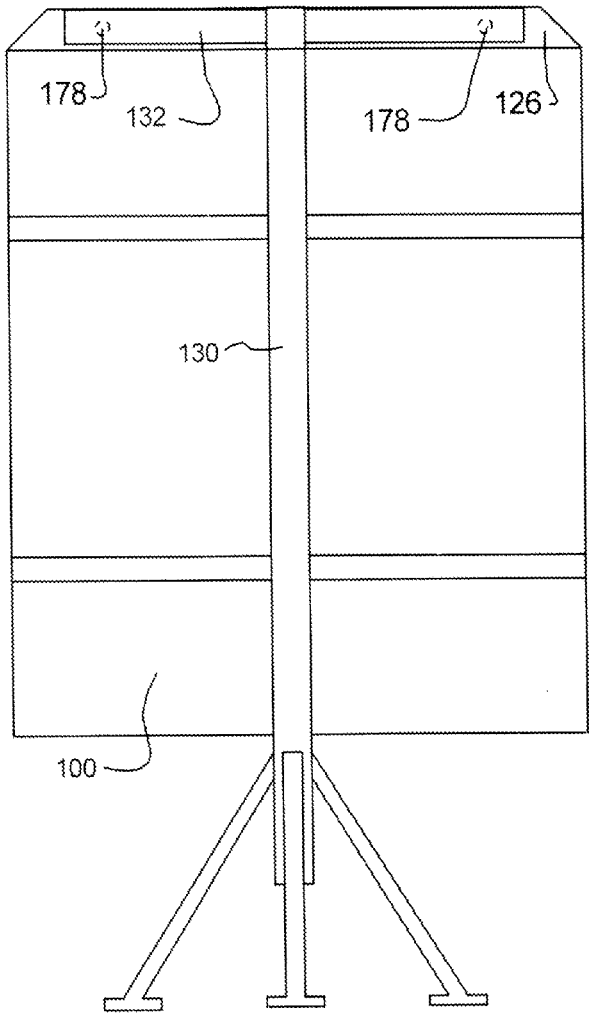
FIG. 5 is a back view of an embodiment of the invention
Figure 6:
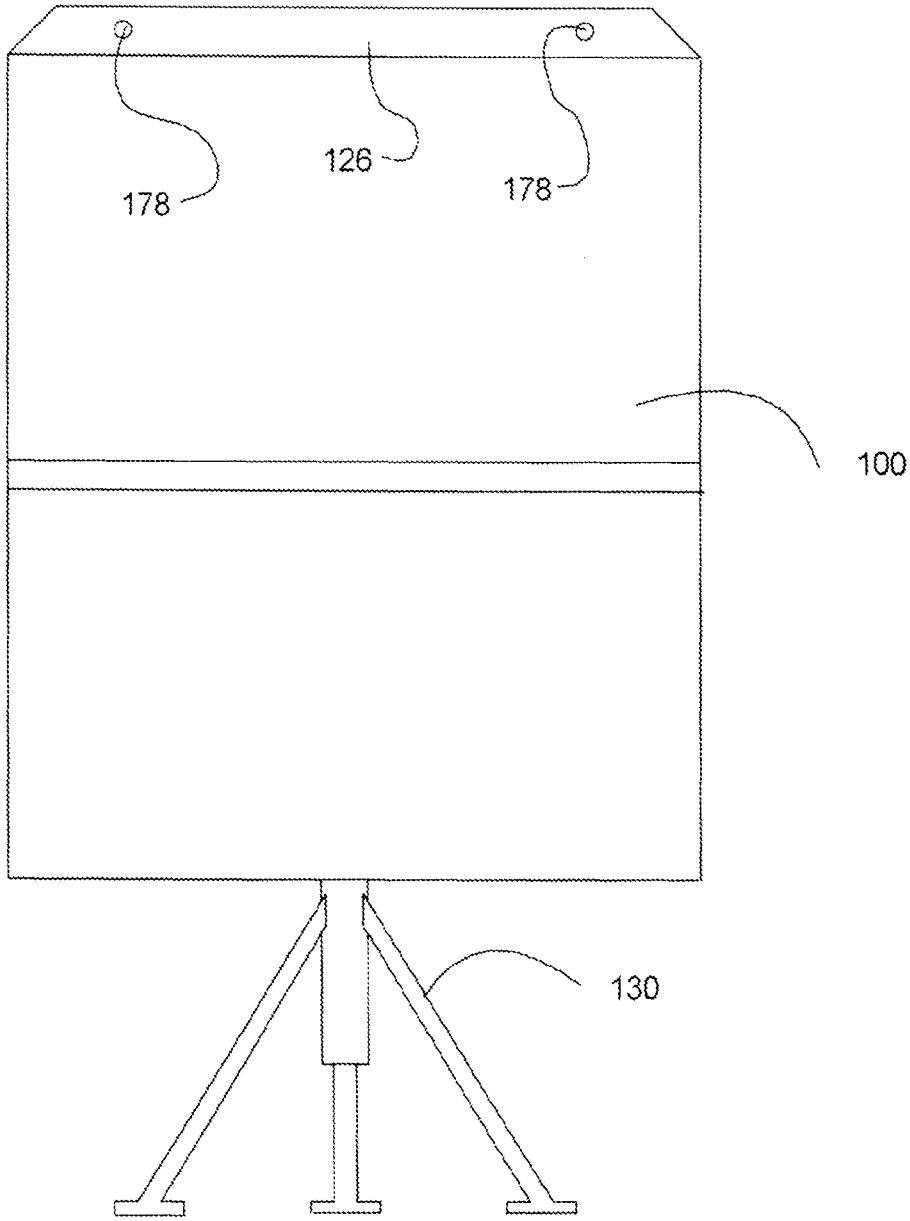
FIG. 6 is a front view of an embodiment of the invention.
Figure 8:
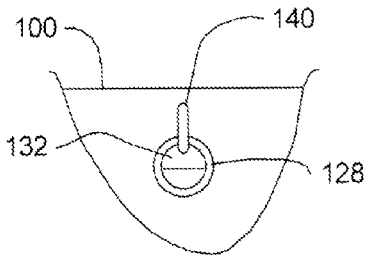
FIG. 8 is a front view of elements of an embodiment of the invention.
Figure 8A:
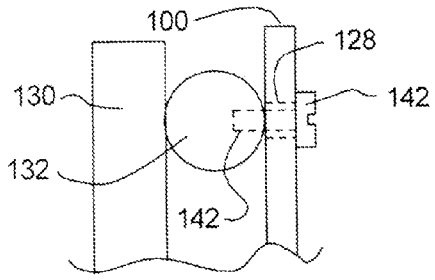
FIG. 8A is a side view of elements of an embodiment of the invention.

In example, FIGS. 4, 5, and 6 show a collapsible stand (130) having a cross member (132) with the segmented acoustic panel (100) suspended therefrom by any suitable connective device. In example, FIG. 8 shows the segmented acoustic panel (100) suspended from the cross member (132) by means of a hook (140) extending from the cross member (132) through the mounting hole (178). FIG. 8A shows the segmented acoustic panel (100) suspended from the cross member (132) by a bolt (142) extended from the cross member (132) through the mounting hole (128) to rigidly communicate with the cross member (132). Thus, the segmented acoustic panel (100) may be placed in operative disposition by movement and/or placement of the stand (130).

Figure 13:
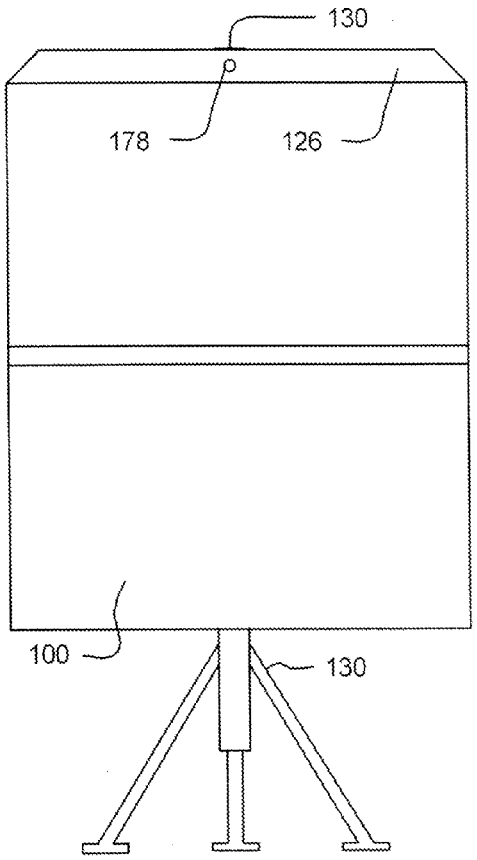
FIG. 13 is a front view of an embodiment of the invention.
Figure 13A:
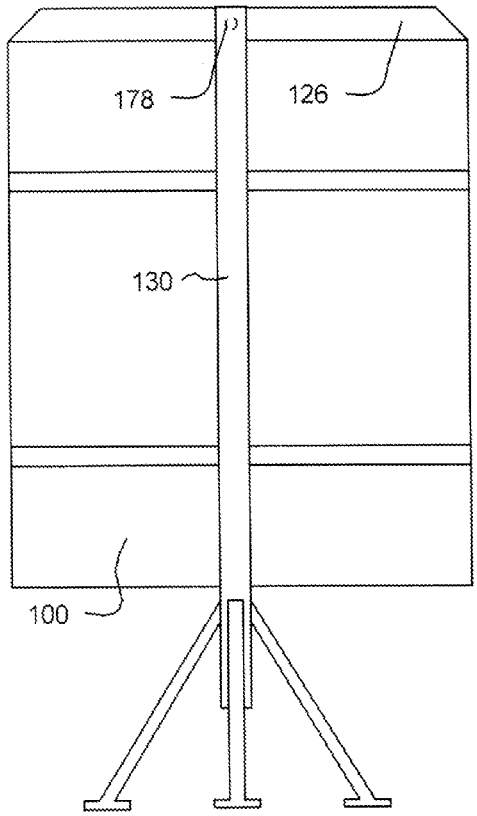
FIG. 13A is a back view of the embodiment of the invention shown in FIG. 13.

FIGS. 13 and 13A show that the segmented acoustic panel (100) may be suspended from the collapsible stand (130) by means of one mounting hole (178) placed in the flange (126). Also noted is that in such instance, the cross member (132) may be eliminated.

Figure 1C:
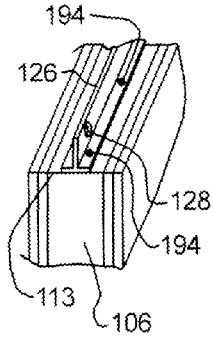
FIG. 1C is an elevational view of elements of an embodiment of the invention.

Now it will be readily appreciated that the segmented acoustic panel (100) need not be suspended from a stand (130) but might be suspended from appropriate connective devices, in example the previously mentioned hook (140) or bolt (142) temporarily affixed to a wall, beam, door, or other element comprising a chamber or other sound production venue. In addition, it will be understood that the segmented acoustic panel (100) need not be suspended by means of the flange (126) comprised by the outer covering (116) as previously described but may be suspended by means of any suitable device attached directly to the segment core top side (113). In example, as in FIG. 1C wherein a flange (126) having a mounting hole (128) is attached to the segment core top side (113) by means of screws (194).

It will also be readily appreciated that the previously described spanning of the panel gap (124) by the acoustic belt (162) and or the outer covering (116) will provide a portion or portions of the segmented acoustic panel first face (102) and or segmented acoustic panel second face (104) having an essentially uniform surface having an area essentially that of the segment core first sides (108) of essentially adjacent segment cores (106) plus the area of the portion of the acoustic belt (162) or the outer covering (116) spanning the gap (124) or an area essentially that of the segment core second sides (110) of essentially adjacent segment cores (106) plus the area of the portion of the acoustic belt (162) or the outer covering (116) spanning the gap (124).

FIG. 7 shows the segmented acoustic panel (100) disposed with segments (123) folded back on each other by means of hinges (180) contrived and positioned as previously described. Also shown is the collapsible stand (130) with cross member (132) in collapsed configuration. Now it will be understood that the elements (100 and 130) will fit into a case (136) whereby the elements (100 and 130) may be conveniently transported. It will also be readily appreciated that the foldability of the segmented acoustic panel (100) and the collapsibility of the stand (130) will facilitate storage.

FIG. 7 shows the case (136) as having a segmented acoustic panel compartment (137) and a separate collapsible stand pocket (138). However, other suitable configurations for the case (136) which will contain both the segmented acoustic panel (100) and the collapsible stand (130) could easily be contrived by one skilled in the art.

Figure 9:
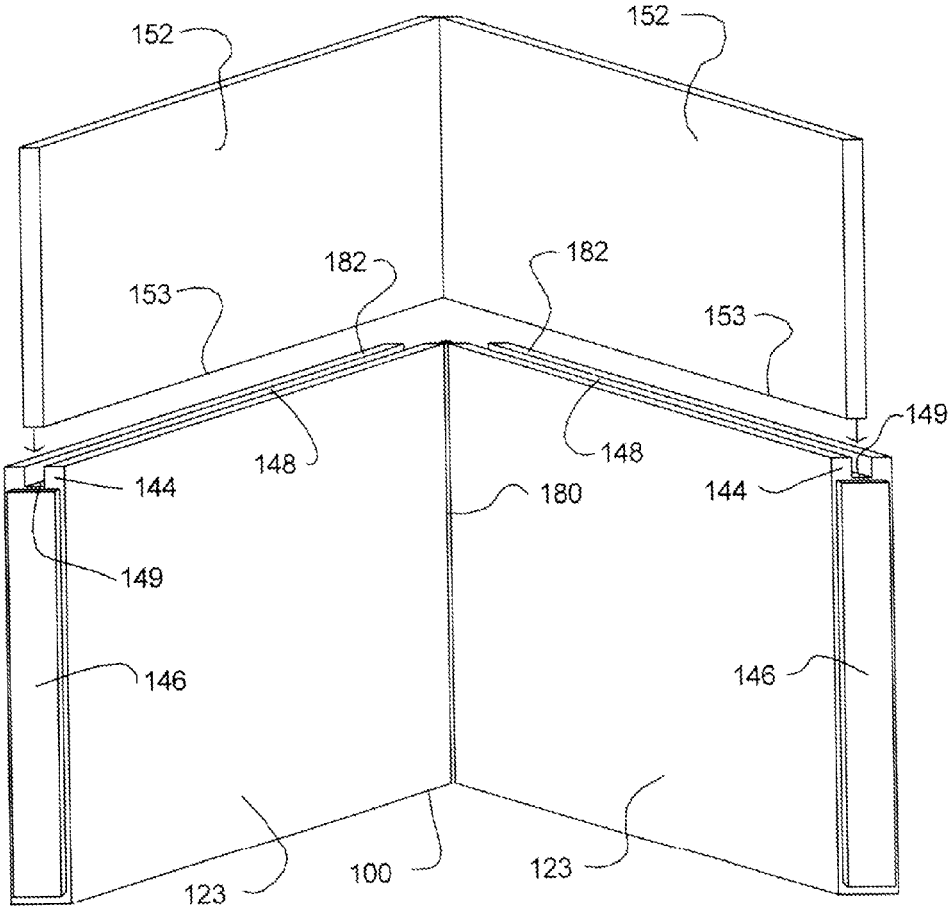
FIG. 9 is an elevational view of an embodiment of the invention.

FIG. 9 shows that the segmented panel (100) may comprise a top side (182) having a groove (148) extending the length thereof, the groove (148) contrived to receive an acoustic shield section (152). The segmented panel (100) also comprises ends (144) which may comprise pads (146).

In the art of acoustic modification of spaces, it is often desirable to isolate sound sources from each other, in example, in the recordation of music, musicians are frequently recorded individually and the individual performances later mixed together to comprise an ensemble sound. Thusly, the ensemble sound may be adjusted by variance of its component parts to produce the most pleasing result. The isolation of sound sources is generally accomplished by means of specially designed chambers which allow no sound produced within to escape and which allow no sound produced without to penetrate.

FIG. 9 shows a segmented acoustic panel (100) having two segments (123). Each segment (123) has an end (144) and the segments (123) communicate by means of a hinge (180) allowing each segment (123) to be positioned or re-positioned relative the other. Each segmented panel (100) also has a top side (182) comprising a groove (148) having a seat (149). The segment ends (144) may comprise pads (146).

Also shown are acoustic shield sections (152) having bottom ends (153) contrived to fit into grooves (148) with clearance necessary to allow insertion into or withdrawal of the grooves (148). The communication of the grooves (148) and the acoustic shield sections (152) is essentially sound proof due to maximum possible contact between the acoustic shield section bottom ends (153) and the segmented panel groove seats (149).

Looking at FIG. 9, one skilled in the art will readily appreciate that the segmented acoustic panel (100) may be exploited by itself without communication with other components to provide barriers between sound production devices and audiences or microphone.

Figure 11:
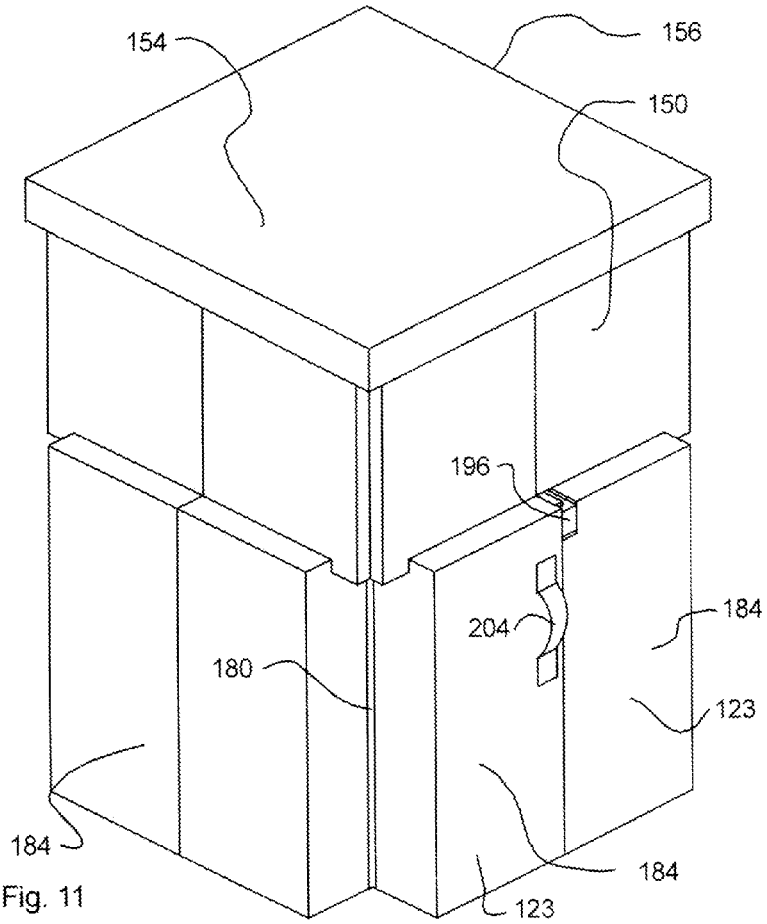
FIG. 11 is an elevational view of an embodiment of the invention.
Figure 12:
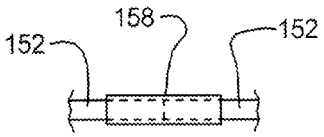
FIG. 12 is a top view of elements of an embodiment of the invention.
Figure 12B:
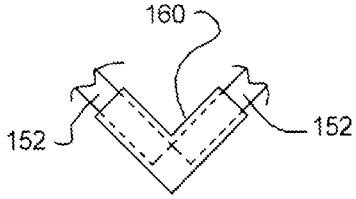
FIG. 12B is a top view of elements of an embodiment of the invention.
Figure 12A:
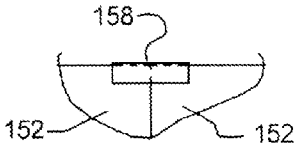
FIG. 12A is a front view of elements of an invention embodiment seen in FIG. 12.

FIGS. 12 and 12A show that in order to fix abutting acoustic shield sections (152) in an operative, abutting configuration, and/or to enhance the stability of the acoustic shield (150) as it communicates with the acoustic box (184), as seen in FIG. 11, the abutting acoustic shield sections (152) may comprise a shield section linear clamp (158) to fix essentially co-linear sections (152) in position.

Figure 12C:
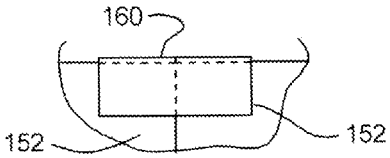
FIG. 12C is a side view of elements of an invention embodiment seen in FIG. 12B

FIGS. 12B and 12C show that if the abutment, that is operative configuration, of acoustic shield sections (152) is other than essentially co-linear, the abutting acoustic shield sections (152) may comprise an angular acoustic shield section clamp (160) to fix the abutting acoustic shield sections (152) in operative disposition and/or to enhance the stability of the acoustic shield (150).

One skilled in the art will readily appreciate that the angular acoustic shield section clamp (160) may be easily contrived to conform to essentially any angle at which acoustic shield sections (152) may abut.

Figure 10:
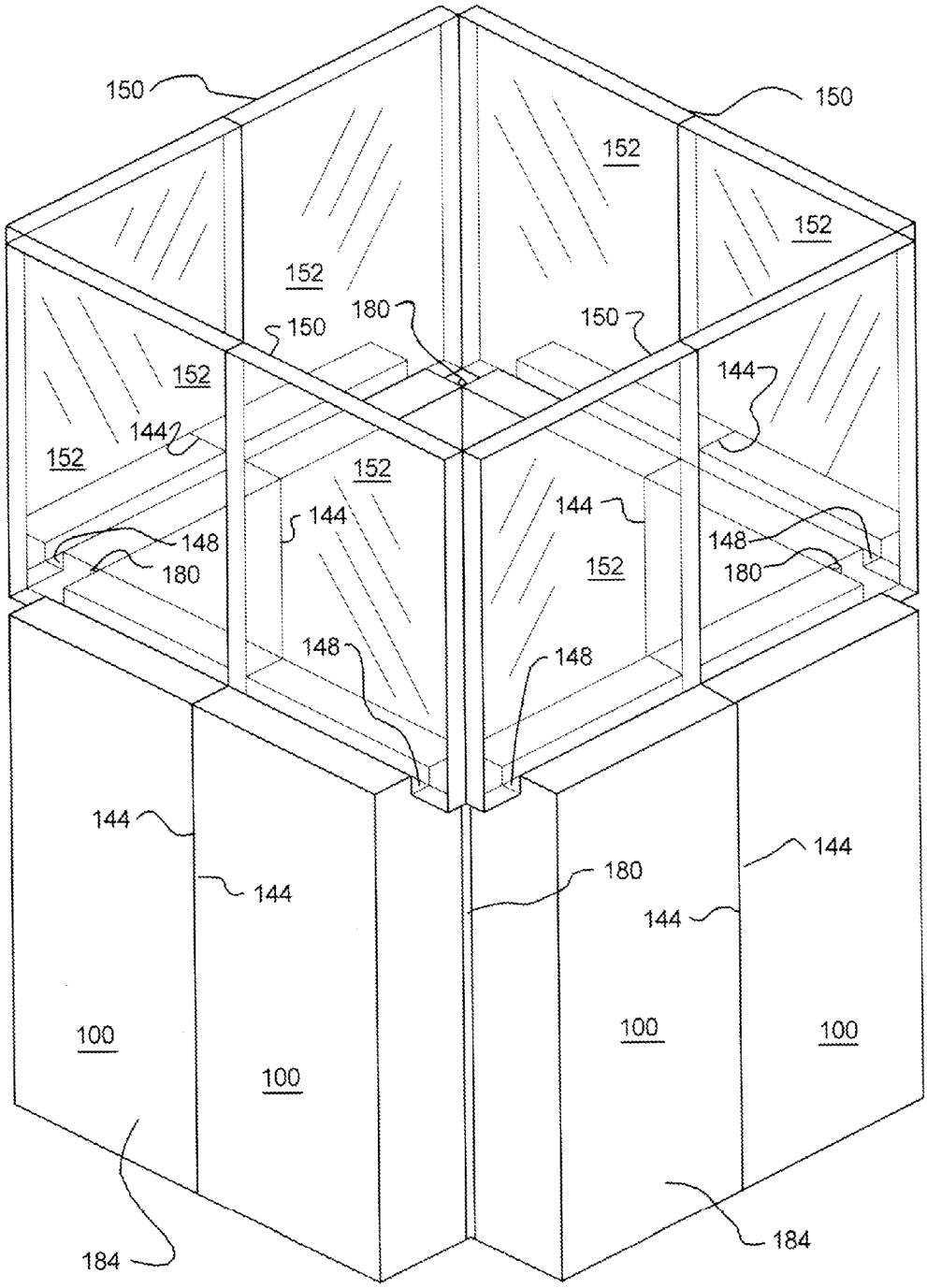
FIG. 10 is an elevational view of an embodiment of the invention.

FIG. 10 shows a plurality of segmented acoustic panels (100) oriented such that segment ends (144) abut so that the panel segments (123) comprising the ends (144) are essentially co-linear. The panel segments (123) comprising hinges (180) are disposed essentially normal each other. Now, it will be readily appreciated that the segmented panels thusly positioned comprise an acoustic box (184). Also shown are acoustic shield sections (152) inserted into grooves (148) so that the acoustic shield sections (152) abut. Thus the acoustic shield sections comprise an acoustic shield (150).

FIG. 11 shows that the acoustic box (184) in combination with the acoustic shield (150), an acoustic isolation chamber top (156) and a surface (188) on which the acoustic box (184) rests comprise an acoustic isolation chamber (154) which will isolate sound produced therein from area external to the acoustic isolation box (154). Additionally understood is that the acoustic properties of the acoustic box (184), acoustic shield (150), and the cover (186) may be such that the sound produced within the acoustic isolation chamber (154) will be essentially uniform and essentially identical to the original sound produced throughout the acoustic isolation box (154). Also understood is that the sound isolation chamber (154) interior surfaces may comprise sound absorptive and/or sound reflective properties.

Figure 11A:
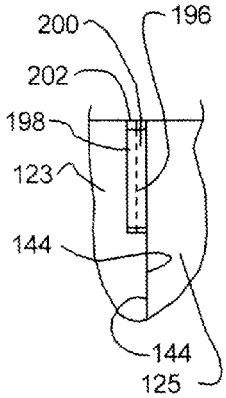
FIG. 11A is a view of an embodiment of the invention.

FIGS. 11 and 11A show that abutting segment panel ends (144) may comprise a connective device (196). In example as in FIG. 11A which shows the panel segment (123) having a recess (202) comprising a plate (200) and a second segment panel (125) comprising a hook (198). Now it will be understood that the hook (198) will engage the plate (200) so as to prevent separation of the panel segment (123) and the second panel segment (125).

FIG. 11 Additionally shows that the panel segment (123) may comprise a handle (204) to facilitate the pivoting of said panel segment (123) about the hinge (180).

Figure 14:
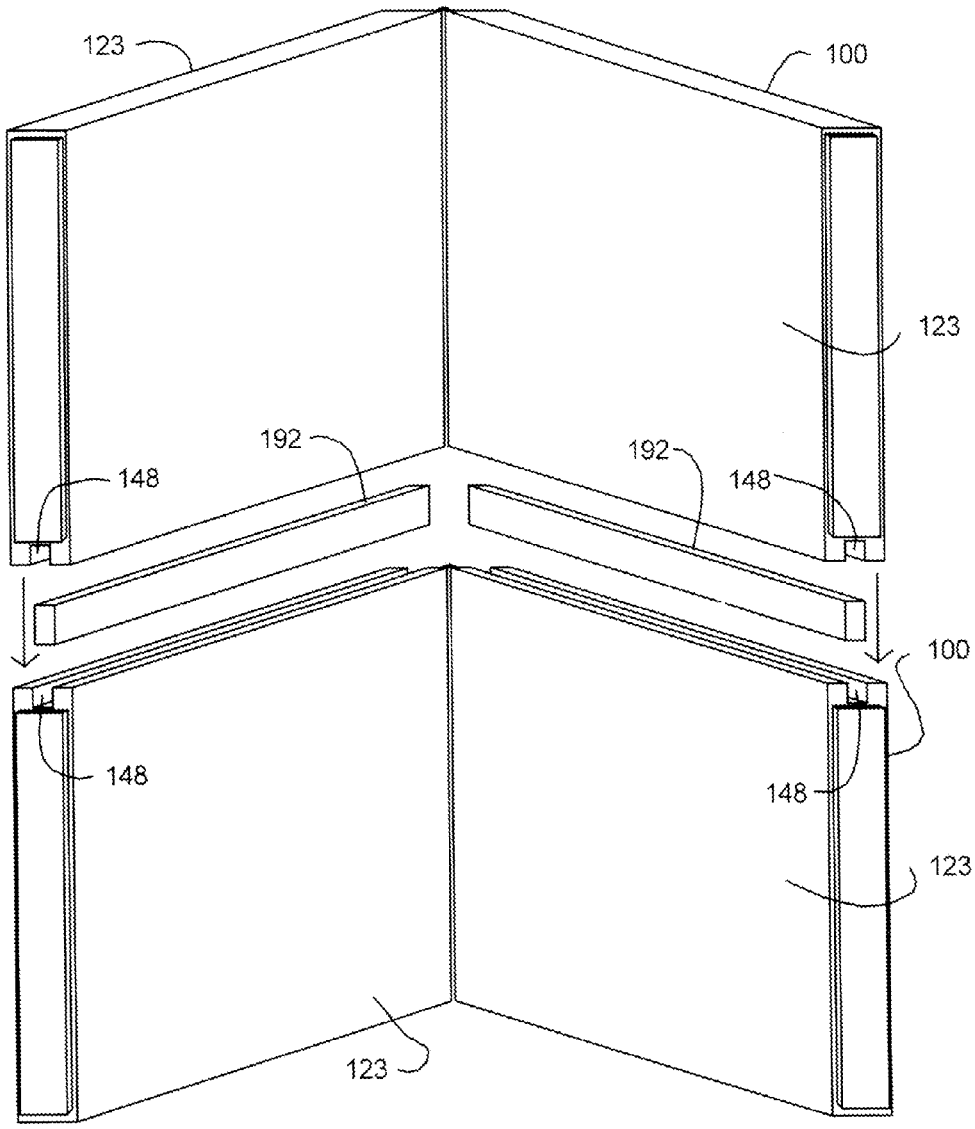
FIG. 14 is an exploded view of an embodiment of the invention.
Figure 14A:
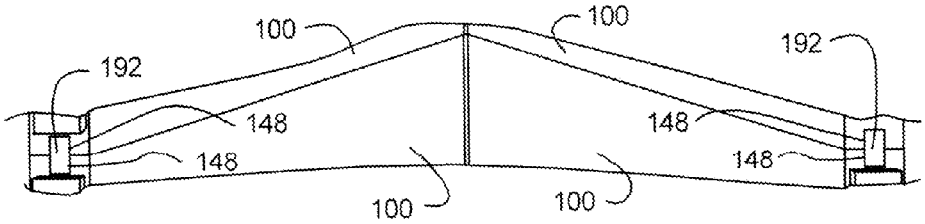
FIG. 14A is a partial elevational view of the invention embodiment shown in FIG. 14.

FIGS. 14 and 14A show that a plurality of segmented acoustic panels (100) having grooves (148) may comprise an acoustic barrier or wall. In example, FIG. 14 shows that a plurality of acoustic panels (100) having grooves (148) may be oriented so that said grooves (148) of one are essentially opposite the grooves (148) of another. Thus, a key (192) may be positioned to simultaneously communicate with, that simultaneously fit into, the grooves of a plurality of segmented acoustic panels (100).

In example FIG. 14A shows segmented acoustic panel (100) stacked atop another segmented acoustic panel (100) with the key (192) communicating with the grooves (148) of both segmented acoustic panels (100) with clearance necessary to allow insertion into or withdrawal from the grooves (148) of the key (192).

It will therefore be understood that the key (192) will tend to prevent motion of one segmented acoustic panel (100) relative another stacked on top of it.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device capable of acoustic reflection, or alternatively or concurrently, of acoustic absorption, comprising:

two or more panels, each comprising;

a front face, a back face, a top end, a bottom end, a first side, a second side;

said two or more panels so adjacently disposed as to proximally align one or more said panel first sides with adjacent one or more panel second sides;

one or more said adjacently disposed first and second sides spanned from one to another respectively by one or more belts;

each said belt so disposed as to overlay two or more panel front faces or alternatively or concurrently, two or more panel back faces, or alternatively or concurrently each belt so disposed as to overlay one panel front face and alternatively or concurrently one panel back face.

2. A device as in claim 1 having a coverture, said coverture covering the front face of one or more panels, said panels, if plural, adjacently disposed, so as to align one or more first sides proximal one or more second sides, leaving a gap between said first and second sides; said gap spanned by said coverture.

3. A device as in claim 1, one or more top ends comprising a groove.

4. A device as in claim 3 comprising one or more acoustic shield segments seatable in one or more said grooves.

5. A device as in claim 3 comprising one or more visually transparent acoustic shield segments seatable in said one or more grooves.

6. A device as in claim 3 comprising a key seatable in one or more said grooves.

7. A device as in claim 1 having a top cover.

8. A device as in claim 1 wherein said belt communicates with and can function as a hinge between adjacent panels.

9. A device as in claim 1 wherein one or more belts comprise a plurality of layers.

10. A portable and storable device capable of acoustic reflection, or alternatively or concurrently, of acoustic absorption, comprising:

two or more panels, each panel comprising;

a front face, a back face, a top end, a bottom end, a first side, and a second side, said one or more top ends comprising a groove, or alternatively or concurrently, said one or more bottom ends comprising a groove;

said two or more panels so adjacently disposed as to proximally align one or more said panel first sides with adjacent one or more panel second sides;

said adjacently disposed first and second sides spanned from one to another respectfully by one or more belts, each said belt so disposed as to overlay two or more panel front faces or, alternatively or concurrently, two or more panel back faces, or alternatively or concurrently, each belt so disposed as to overlay one panel front face or, alternatively or concurrently, one panel back face;

a coverture, said coverture covering the front face of one or more panels, said panels, if plural, adjacently disposed, so as to align one or more first sides proximal one or more second sides, leaving a gap between said first and second sides; said gap spanned by said coverture;

one or more acoustic shield segments seatable in one or more said grooves, one or more said acoustic shield segments being transparent; or alternatively or concurrently, being a key seatable in one or more said grooves.

11. A device as in claim 10 having a top cover.

* * * * *